US005625444A

United States Patent [19]

Suzuki et al.

[11] Patent Number: 5,625,444

[45] Date of Patent: Apr. 29, 1997

[54] IMAGE FORMING APPARATUS WITH AIR BLOWER TO SECURE RECORDING MATERIAL TO CONVEYING DEVICE

[75] Inventors: Kazuo Suzuki, Yokohama; Takahiro Kubo, Tokyo; Hisakazu Ohkubo, Yokohama, all of Japan

[73] Assignee: Canon Kabushiki Kaisha, Tokyo, Japan

[21] Appl. No.: 668,972

[22] Filed: Jun. 24, 1996

Related U.S. Application Data

[63] Continuation of Ser. No. 374,100, Jan. 18, 1995, abandoned.

[30] Foreign Application Priority Data

Jan. 24, 1994 [JP] Japan ..... 6-022168

[51] Int. Cl.[6] ..... G03G 21/00

[52] U.S. Cl. ..... 399/400; 399/68

[58] Field of Search ..... 355/308, 309, 355/312, 282, 285; 271/3.22, 3.23, 90, 94, 194, 265.01, 275, 276

[56] References Cited

U.S. PATENT DOCUMENTS

| | | | |
|---|---|---|---|
| 3,743,403 | 7/1973 | Sanza | 355/312 |
| 4,084,806 | 4/1978 | Wenthe et al. | 271/194 X |
| 4,959,693 | 9/1990 | Mitsuya et al. | 355/312 X |
| 5,016,060 | 5/1991 | Arai | 355/312 |
| 5,031,002 | 7/1991 | Yaguchi | 355/312 |
| 5,063,415 | 11/1991 | Ariyama | 355/312 |
| 5,255,905 | 10/1993 | Reid et al. | 271/94 |
| 5,392,107 | 2/1995 | Paxon | 355/312 |

*Primary Examiner*—Sandra L. Brase

*Attorney, Agent, or Firm*—Fitzpatrick, Cella, Harper & Scinto

[57] ABSTRACT

An image forming apparatus has the capability of maintaining good contact between a recording material and a recording-material carrying belt so that stable carrying force is obtained, thereby preventing deformation of an image due to a failure for the recording material to enter a fixing unit or due to contact of the recording material with some element present above the recording-material carrying belt. The image forming apparatus includes an air fan for generating a wind pressure applied to a recording material in a direction that presses the recording material against a recording-material carrying belt. In an enhanced mode, two or more air fans are arranged in a direction crossing the recording-material carrying direction.

33 Claims, 6 Drawing Sheets

IMAGE FORMING APPARATUS WITH AIR BLOWER TO SECURE RECORDING MATERIAL TO CONVEYING DEVICE

This application is a continuation of application Ser. No. 08/374,100, filed Jan. 18, 1995, now abandoned.

BACKGROUND OF THE INVENTION

1. Filed of the Invention

The present invention relates to an image forming apparatus such as a copying machine, laser beam printer (LBP), facsimile machine, etc., based on electrophotography or electrostatic recording technology.

2. Description of the Related Art

One of conventional image forming apparatus of this type is a full-color image forming apparatus such as that shown in FIG. 6.

This image forming apparatus comprises: an image forming portion 100 having an image holding element 101 on which an image is formed with a developing powder; a transfer portion 105 for transferring the developed image formed on the image holding element 101 onto a recording material P such as paper; and a fixing portion 109 disposed at a location on the downstream side of the transfer portion 105, for fixing the image that has been developed and transferred onto the recording material.

The image forming portion 100 comprises: an electrifier 102 such as a corona discharging element for uniformly charging the surface of the image holding element 101; a scanning optical system 103 for scanning and exposing the image holding element 101 electrified with a charge by an optical image E with separated colors thereby forming an electrostatic latent image; a developing unit 104 including developing elements 104*y*, 104*m*, 104*c*, 104*bk* for yellow, magenta, cyan, and black, respectively, for developing the electrostatic latent image.

An image is formed as follows: First, the image holding element 101 is charged by the charging element 102. An optical image E is then projected onto the image holding element 101 for each separated color thereby forming a electrostatic latent image. A proper developing element 104*y*, . . . of a developing unit 104 is moved to a developing position opposite to the image holding element 101, and the electrostatic latent image formed on the image holding element 101 is developed, thereby forming a developed image with a developing powder such as resin-based toner.

The developed image is transferred onto a recording material P that has been fed to a location between the image holding element 101 and the transfer roller 105*a* from a recording material cassette 107 via a feeding system along a path represented by broken lines in FIG. 6.

The transfer portion 105 comprises: a recording material holder 105*a* including a transfer drum; a transfer electrifier 105*b*: a sticking roller 105*g* disposed opposite a sticking electrifier 105*c*, for electrostatically attracting the recording material P onto the recording material holder 105*a*; an inner electrifier 105*d*; and an outer electrifier 105*e*; wherein a recording-material holding sheet 105*f* made up of a dielectric material is extended across an open area of the cylindrical surface of the transfer drum 105*a* thereby constructing a cylinder in an integral form.

As the recording material holder 105*a* rotates, the developed image on the image holding element 101 is transferred part by part onto the recording material P held on the recording-material holding sheet 105*f*.

A desired number of colored images are transferred in a superimposed fashion onto the recording material P that is held and carried by the recording-material holding sheet 105*f*, thereby forming a full-color image.

After the completion of the transfer of the desired number of developed images, the recording material P is separated from the recording-material holder 105*a* by separating means 108, and then carried to a fixing unit 109 by carrying means 150 such as a carrying belt disposed between the transfer portion 105 and the fixing unit 109. In the fixing unit, the unfixed image is heated and thus fixed. The recording material P is then fed out onto a tray 110.

After the completion of the image transfer process, the image holding element 101 and the recording-material holding sheet 105*f* are cleaned by a cleaner 106 and a transfer cleaner 114, respectively, so as to remove a residual developing powder from their surfaces, thereby preparing the next image forming process.

However, in the case where images are copied on both surfaces of a recording material P, the recording material P is curled to a great extent toward the image surface after each fixing process. This is particularly true when a high-density image is formed on the first surface. This is because when the recording material cools, the surface on which the developing powder is present will contract to a greater extent than will the surface on which no developing powder is present.

After the fixing process, the curling increases with time as the temperature of the recording material lowers. As a result, when a high-density image is formed on a first surface of a recording material, the recording material often separates from the recording-material holder 105*a* during the process of forming an image on the second surface, and the curled recording material is carried to the fixing unit 109, which causes a problem described below.

When such a recording material P is carried from the recording-material holder 105*a* to the fixing unit 109, the recording material P on the recording-material carrying means 150 is curled downward, and therefore the recording material P is partially separated from the recording-material carrying means 150. As a result, the carrying force becomes insufficient, and thus the recording material P sometimes blocks its travelling path, which will cause a failure in carrying a recording material.

Even in the case where a recording material P does not block the travelling path, when an end portion of the recording material P comes into contact with a fixing nip 109*a* formed by a pair of fixing rollers of the fixing unit 109, mechanical resistance may cause the recording material P to slip along the carrying surface of the carrying means 150 and thus cause a failure in entering the recording material into the fixing nib 109*a*. Under these circumstances, the trailing end portion of the recording material present between the transfer portion 105 and the image holding element 101 fails to keep good synchronization with the image holding element 101, and therefore the image is disturbed.

Furthermore, if a recording material P is excessively curled, the image face sometimes comes in contact with some element disposed at a location above the recording-material carrying means 150 between the transfer portion 105 and the fixing portion 109, which will cause a deformation in an image. In this case, another problem with the carrying of the recording material P may further occur, and thus the image may be disturbed due to the failure of synchronization at the transfer portion.

The above-described problems occur not only in image forming apparatus based on electrophotography or electrostatic recording technology employing an image holding element having photosensitivity, but also in some types of printers such as an ink-jet printer in which an image is formed directly on a recording material itself by depositing ink droplets on it. Such a printer also has the problem of the recording material being curled due to the difference in expansion between the surface with deposited ink and the other surface with no ink. A trouble in carrying a recording material may cause a deformation in an image formed by an image forming portion, and contact with something located above a carrying means may also produce a deformation in the image.

SUMMARY OF THE INVENTION

It is an object of the present invention to solve the above problems. More specifically, it is an object of the present invention to provide an image forming apparatus capable of maintaining a recording material in good contact with recording material carrying means in order to prevent a deformation of an image due to a failure of the recording material to enter a fixing unit or due to contact of the recording material with some element that is present above the recording material carrying means.

According to an aspect of the present invention to achieve the above objects, there is provided an image forming apparatus comprising: image forming means for forming an image on a recording material, fixing means for fixing the image formed on the recording material, recording-material carrying means for carrying a recording material from the image forming means to the fixing means, and air blowing means for generating a wind pressure in a direction that presses the recording material against the recording-material carrying means.

The image forming means may feature electrophotography or electrostatic recording technology in which a developed image is formed by developing an electrostatic latent image on an image holding element with a developing powder, such as toner, and then the developed image is transferred onto a recording material via transferring means. Alternatively, the image forming means may be implemented according to a technique in which ink droplets are directly deposited onto a recording material itself, thereby forming an ink image on it.

According to another aspect of the present invention, there are provided at least two air blowing means arranged along a line perpendicular to the recording-material carrying direction.

In accordance with another aspect of the present invention, there is provided an image forming apparatus as described above, wherein the recording material carrying means carries recording materials having widths ranging from a narrowest width to a widest width, and each of the air flow generating devices is present above at least a part of the path of a recording material of the narrowest width.

In accordance with still another aspect of the present invention, there is provided an image forming apparatus as described above, further comprising a control means for controlling operation of the air blowing means, wherein the image forming means forms an image on first and second surfaces of the recording material and the control means activates the air blowing means only during a process for forming an image on the second surface of the recording material.

In accordance with still yet another aspect of the present invention, there is provided an image forming apparatus as described above, further comprising a separating device for separating the recording material from the image forming means, wherein the control means activates the air blowing means in synchronization with operation of the separating device.

The air blowing means is preferably such means that generates an air flow by rotation such as an air fan.

In the present invention, a wind pressure is applied so as to press a recording material against carrying means by using air blowing means such as an air fan disposed above the carrying means extending to a fixing unit so that the recording material is maintained in good contact with the carrying means thereby maintaining sufficient carrying force.

With the arrangement according to the present invention, even a curled recording material is pressed against the carrying surface of the carrying means by the wind pressure produced by the air blowing means so that no portion of the recording material is separated in a significant way from the carrying surface, thereby preventing the recording material from failing to enter the fixing unit and also from contacting some element disposed above the carrying means. Thus, a correct image can be obtained without deformation.

If there are a plurality of air blowing means, then the air blowing means can provide a wind pressure that is high enough to strongly press a recording material against the carrying means without disturbing an unfixed image. Thus, it is possible to achieve excellent carrying performance for various recording materials such as a rigid material or a material that would be curled to such a great extent that only one air blowing means would not be able to deal with it well.

Furthermore, if two air blowing means are disposed in such a manner that a part of each air blowing means is located above the path area of the narrowest suitable recording material, then it is possible to prevent a recording material having a small width from being blown by a wind applied to the recording material in a lateral direction, and it is also possible to prevent the wind pressure from becoming too large for a recording material having a small size.

On the other hand, when a recording material having a greater size is used, an greater area of the recording material can receive the wind and thus the recording material is pressed properly.

Furthermore, if the air blowing means is adapted to have a rotating element for generating an air stream, then it is possible to readily control the wind pressure by controlling the rotation speed. More specifically, an air fan can be employed as the air blowing means to simply realize the above construction.

DETAILED DESCRIPTION OF PREFERRED EMBODIMENT

Referring to the accompanying drawings, preferred embodiments will be described below.

First Embodiment

Figure 2:
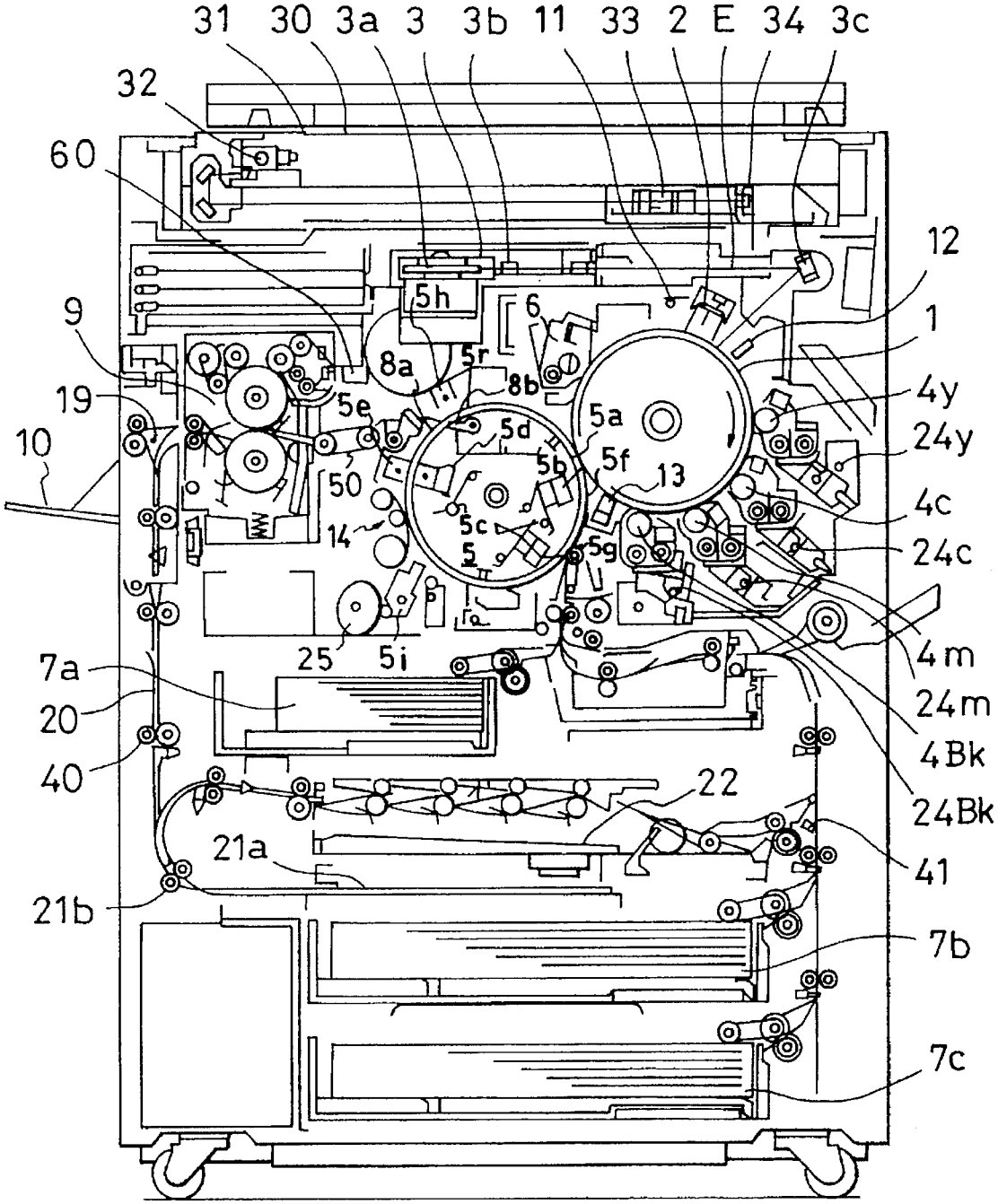
FIG. 2 is a schematic diagram generally illustrating the construction of the image forming apparatus according to the first embodiment of the present invention.

FIG. 2 illustrates a color image forming apparatus according to a first embodiment of the present invention. The image forming apparatus has an image reader portion in its upper region and an image printer portion serving as image forming means in the lower region.

In the image reader portion, an original document 30 placed on a document glass 31 is scanned and exposed by an exposure lamp 32 so that light reflected from the document 30 is focused via a lens 33 to form a reflection image onto a full-color sensor 34, which in turn generates an image signal with color-separation components. The color-separated image signal is applied to a video processing unit (not shown) via an amplifier (not shown). After the completion of the video processing, the image signal is transmitted to the image printer portion.

In the image printer portion, there is provided a photosensitive drum 1 serving as an image holding element having a photosensitive material such as an organic conductor disposed around its cylindrical surface. The photosensitive drum 1 is supported in such a manner that it can rotate freely in the direction denoted by the arrow in FIG. 2. Outside of the photosensitive drum 1, there are provided a pre-exposure lamp 11, an electrifier 2 such as a corona discharger, a laser scan-and-exposure optical system 3, a potential sensor 12, four different-color developing units 4*y*, 4*c*, 4*m*, and 4*bk*, drum-surface light intensity detector 13, a transferring unit 5 serving as a transfer portion, and a cleaner 6.

In the laser scan-and-exposure optical system 3, the image signal supplied from the image reader portion is converted by a laser generator (not shown) into an optical signal to be used for the image scan-and-exposure processing. The obtained laser beam is reflected by a polygon mirror 3*a*, and then projected onto the surface of the rotating photosensitive drum 1 via a lens 3*b* and a mirror 3*c*.

When an image is formed in the image printer portion, the photosensitive drum 1 is rotated in the direction denoted by the arrow in FIG. 2 so that the electric charge present on the photosensitive drum 1 is removed by exposure to the pre-exposure lamp 11. Then, the surface of the photosensitive drum 1 is electrified uniformly with a negative charge through the electrifier 2. An optical image E is then projected onto the surface of the photosensitive drum 1 for each separated color thereby forming an electrostatic latent image.

The latent image on the photosensitive drum 1 is reversal-developed using, as appropriate, each of developing units 4*y*, 4*c*, 4*m*, and 4*bk*, to form a toner image on the photosensitive drum 1 with negative resin-based toner serving as a developing powder. Due to the operation of eccentric cams 24*y*, 24*c*, 24*m*, and 24*bk*, the developing unit corresponding to each separated color is selected and is moved toward the photosensitive drum 1 for the developing process.

The toner image on the photosensitive drum 1 is transferred onto a recording material in a sheet form that has been fed from recording material cassette 7*a*, 7*b*, or 7*c* via a carrying system and via a transfer unit 5 to a transfer position opposite the photosensitive drum 1.

In the present embodiment, the transfer unit 5 has a recording material holder 5*a* in the form of a cylinder having a circumference at least twice the length of a recording material having the greatest size; a transfer electrifier 5*b*; a sticking roller 5*g* disposed opposite a sticking electrifier 5*c*, for electrostatically attracting the recording material onto the recording material holder 5*a*; an inner electrifier 5*d*; and an outer electrifier 5*e*. A recording-material holding sheet 5*f* made up of a dielectric material is extended across an open area of the circumferential surface of the transfer drum 5*a* thereby constructing a cylinder in an integral form, wherein the transfer drum 5*a* is supported by bearings so that it can be driven for rotation. The recording-material holding sheet 5*f* is preferably made up of a polycarbonate film or the like.

As the recording material holder 5*a* rotates, the toner image on the image holding element 1 is transferred by the transfer electrifier 5*b* onto the recording material held on the recording-material holding sheet 5*f*. In this way, a desired number of color images are transferred onto the recording material that is held and carried by the recording-material holding sheet 5*f*, and thus a full-color image is formed.

In the case of a full-color image, after the completion of the transfer of a four-color toner image, the recording material is separated from the recording-material holder 5*a* by separating means comprising a separating blade 8*a*, a separation lift roller 8*b*, and a separation electrifier 5*h*. The recording material is then carried to a heat roller fixing unit 9, serving as fixing means, via a carrying belt 50, serving as recording-material carrying means. In the heat roller fixing unit 9, the toner image is fixed by means of heating, and then fed out onto a tray 10.

After the completion of the image transfer process, the photosensitive drum 1 is cleaned by a cleaner 6 so as to remove residual toner from its surface thereby preparing for the next image forming process.

If it is desired to form an image on both surfaces of a recording material, a carrying path switching guide 19 is driven immediately after the recording material has been fed out from the fixing unit 9, so that the recording material is temporarily transferred by conveying rollers 40 and reversal rollers 21*b* to a reversal path 21*a* via a vertical carrying path 20. Then, a reversal roller 21*b* is driven in the opposite direction.

The edge of the recording material that was the trailing edge when it was carried into the reversal path 21*a* now becomes the leading edge, and the recording material is fed out in a direction opposite to that in which it was carried into the reversal path 21*a*. The recording material is carried to an intermediate tray 22 where it is temporarily stored. Then, the above-described image forming process is repeated to form another image on the other surface of the recording material.

In this image forming apparatus, it is possible to adjust the gap between the recording-material holding sheet 5*f* and the photosensitive drum 1 to a desired arbitrary value by operating the eccentric cam 25 at a proper time, thereby operating a cam follower 5*i* integrated with the recording-material holder 5*a*. For example, it is possible to make the distance between the photosensitive drum 1 and the recording-material holder 5*a* large enough for a standby state or a power-off state.

Figure 1:
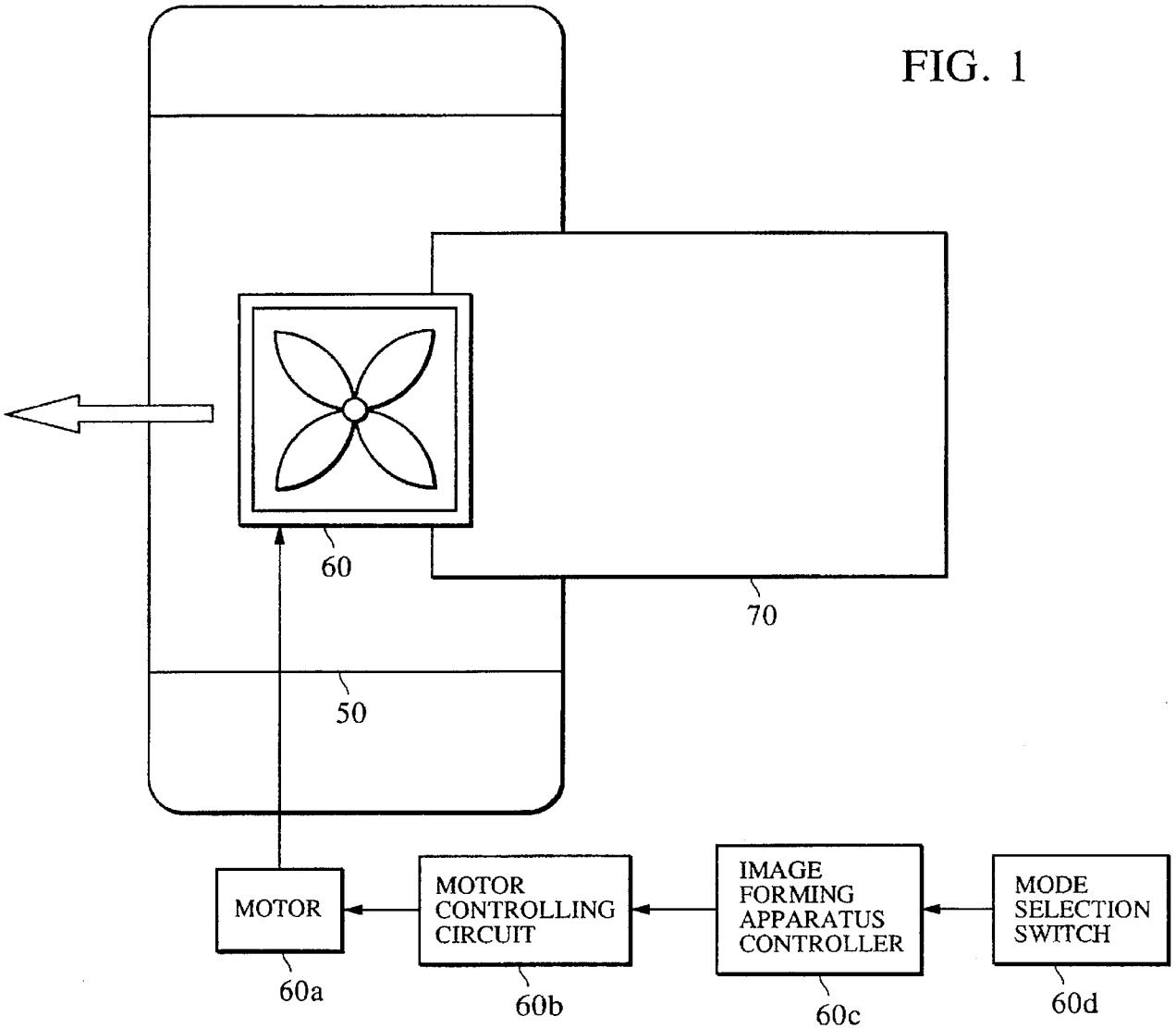
FIG. 1 is a schematic diagram illustrating a carrying portion, seen from the above, of an image forming apparatus according to a first embodiment of the present invention.

Furthermore, as shown in FIG. 1 and FIG. 2, the image forming apparatus according to the present invention has an air fan 60 disposed above the carrying belt 50. The carrying belt 50 serves as recording-material carrying means disposed between the transfer unit 5 and the fixing unit 9 in the image printer portion. The air fan 60 serves as air blowing means for applying wind pressure to a recording material 70 (FIG. 1) thereby pressing it against the carrying belt 50. In this embodiment, one air fan 60 is disposed above the center position of the carrying belt 50, so that a uniform wind pressure is applied downward to a recording material 70.

FIG. 1 is a schematic diagram, seen from the above, of the carrying belt 50 extending to the fixing unit.

The motor 60*a* of the air fan 60, which serves as a motor means, operates under the control of a motor controlling circuit 60*b*. Motor controlling circuit 60*b* serves as a control means. The motor controlling circuit 60*b* operates according to signals provided by an image forming controller 60*c* for controlling the image forming apparatus.

In a practical example, an air fan 60 having a size of 60 mm×60 mm is disposed above the center position of the carrying belt at a height of 70 mm so that a downward air stream is continuously provided during a copying operation.

A wind pressure of 2.5 mmHg is generated at a position 70 mm from the air fan 60. This value of the wind pressure has been determined such that the wind pressure is high enough to press a recording material 70 that would otherwise be excessively curled, and, at the same time, the wind pressure is low enough to cause no deformation of an unfixed image.

Figure 3:
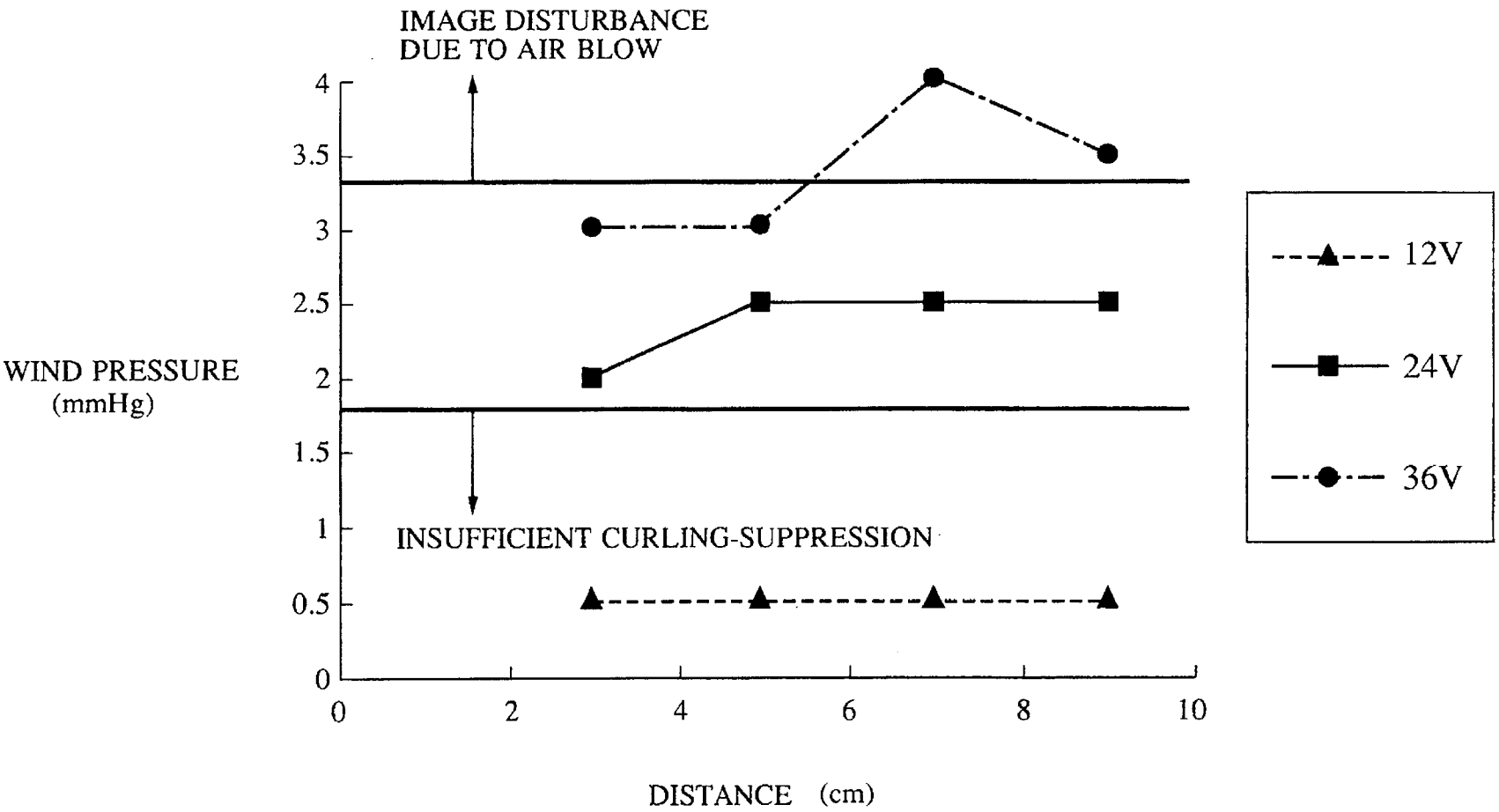
FIG. 3 is a graph illustrating the relationships between the wind pressure produced by an air fan used in the first embodiment and the curling-suppression effect and between that wind pressure and the image disturbance.

FIG. 3 illustrates the wind pressure as a function of the distance H between the air fan 60 and the carrying belt 50 for three different power supply voltages (12 V, 24 V, 36 V) applied to the air fan. In FIG. 3, the middle region represents a proper wind pressure range (1.8 mmHg through 3.3 mm Hg in this case). The rotation speed of the air fan 60 varies according to the applied voltage.

As can be seen from FIG. 3, a low rotation speed obtained at 12 V cannot provide a wind pressure high enough to suppress the curling, even at a close distance. On the other hand, while a high rotation speed obtained at 36 V can give a wind pressure high enough to suppress the curling, the wind pressure exceeds the proper range at some distances, and thus unfixed toner is scattered by the wind, which causes deformation of an image. When 24 V is employed as the applied voltage, a moderate rotation speed is obtained and the resultant wind pressure is generally within the proper range.

According to the present embodiment, as described above, there is provided the air fan 60 disposed above the carrying belt 50 extending from the transfer unit 5 to the fixing unit 9 so that an air stream is provided to press the recording material 70 against the carrying belt 50, thereby preventing the carrying force from becoming insufficient due to the upward separation of the recording material 70 from the carrying belt 50, and also preventing the deformation or distortion of the image due to a failure to enter the fixing nip of the fixing unit 9 or due to contact with some element present above the carrying belt 50, wherein such problems often occur in conventional techniques.

Second Embodiment

Now, another embodiment of an image forming apparatus according to the present invention will be described below.

In the description below, only parts different from those in the first embodiment will be described, and similar or corresponding parts will be denoted by the same reference numerals as those used in the first embodiment.

In the first embodiment described above, even when both surfaces of a recording material are subjected to a copying process, the air fan 60 is always operated regardless of the first or second surface of the recording material. In contrast, in this second embodiment, the air fan 60 is activated only during an operation of forming an image on the second surface.

As described earlier, problems such as insufficient carrying force due to the separation of a recording material from the carrying belt 50, image deformation due to a failure to enter the fixing nip of the fixing unit 9, or image deformation due to contact with some element present above the carrying belt 50, do not occur very often during an operation of forming an image on the first surface. However, such problems often occur during an operation of forming another image on the second surface of a recording material having a high density image on its first surface.

In view of the above, the second embodiment of the present invention includes means for determining whether the image forming process is for the second surface of a recording material whereby the air fan 60 is activated only when it is has been concluded that the second surface is to be processed. In usual apparatus, the double-side copy mode can be selected for example by operating a mode selection switch 60*d* such as that shown in FIG. 1. The means for determining whether the image forming process is for the second surface includes a sensor 41 for detecting a recording material which is fed from, for example, the intermediate tray 22. Image forming immediately after the detection of the recording material by the sensor 41 is determined as being the image forming for the second surface. Thus, the mode selection switch 60*d* may be adapted such that if the double-side copy mode is selected by the mode selection switch 60*d*, the air fan may be activated in response to a timing signal generated when a sensor detects that the recording material 70 to be subjected to the second-surface image forming process reaches a predetermined position. As for the above predetermined position for generating the timing signal, various positions may be employed. For example, the timing signal may be generated when a sensor detects that the recording material has reached the intermediate tray. For the above sake, a sensor for detecting a recording material 70 is disposed at the above-described predetermined position, thereby activating the air fan 60 in response to a detection signal generated by the sensor.

The present embodiment provides the advantages described above in connection with the first embodiment. Moreover, the air fan 60 is operated only during the minimum period required for the operation, and therefore it is possible to reduce the power consumption.

Third Embodiment

In a third embodiment according to the present invention described below, the air fan is operated even more efficiently than the second embodiment.

In this embodiment, air fan 60 is operated only when a recording material 70 in the middle of an image forming process for its second surface and is present on the carrying belt 50.

The recording material holder 5*a* has a separating blade 8*a* for separating a recording material 70 from the recording material holder 5*a* after the completion of transferring of an toner image on the photosensitive drum 1 to the recording material. In this process, a solenoid is activated at a proper timing so that the end of the separating blade 8*a* comes in contact with the recording material holder 5*a*, and then the separating blade 8*a* removes the recording material 70. In this embodiment, the air fan 60 is activated in synchronization with the above-described operation of the separating blade 8*a* so that the air fan 60 is in operation only when a recording material 70 is present on the carrying belt 50. This can be achieved by activating the fan motor controlling circuit 60*b* in response to a signal generated by the image formation control circuit for operating the separating blade.

Fourth Embodiment

Figure 4:
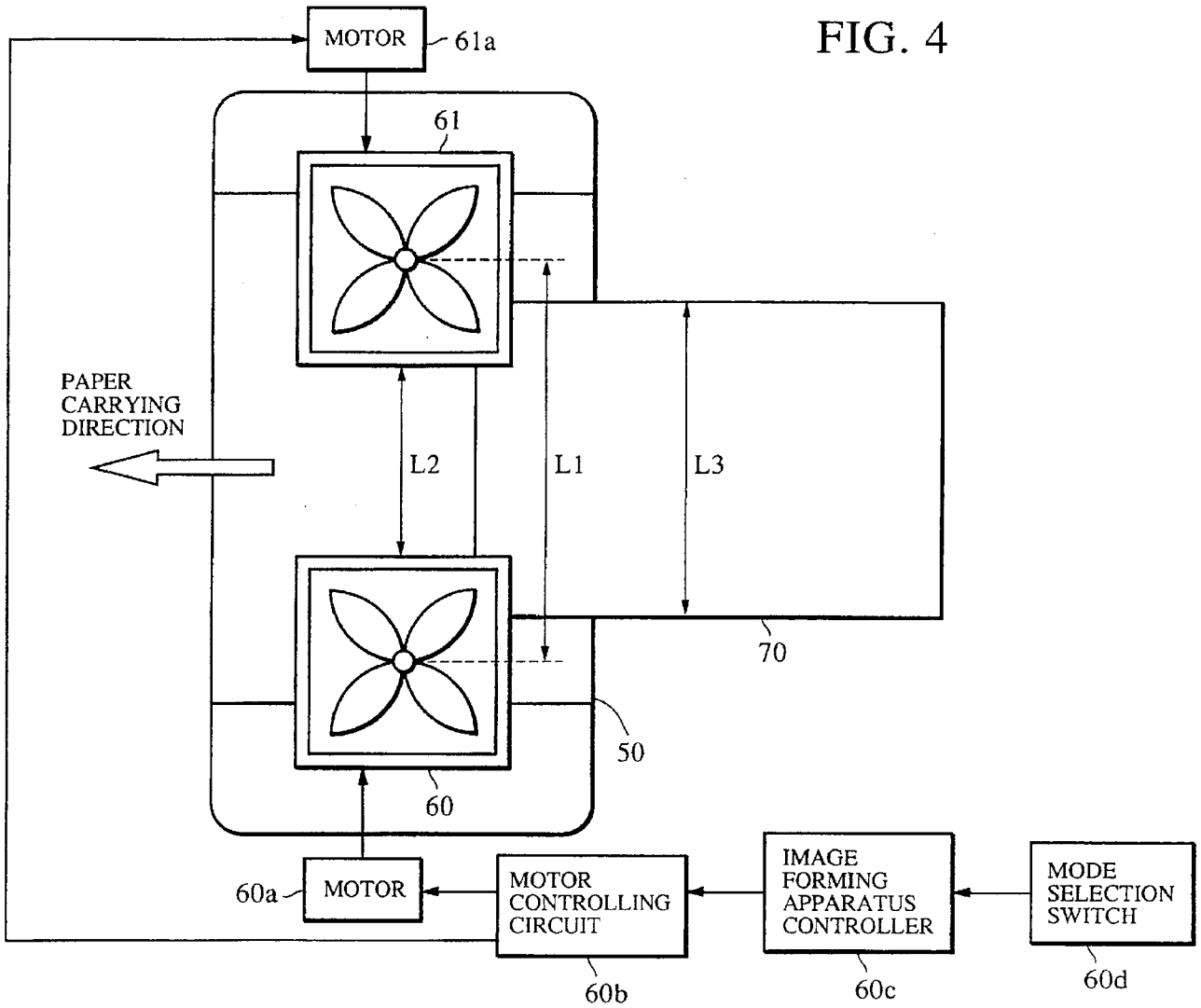
FIG. 4 is a schematic diagram illustrating a carrying portion, seen from the above, of an image forming apparatus according to a fourth embodiment of the present invention.

FIG. 4 illustrates a fourth embodiment of the present invention.

In this fourth embodiment, two air fans 60 and 61 are disposed above the carrying belt 50 in such a manner that they are arranged in the direction perpendicular to the recording-material carrying direction.

As described in the previous embodiments, only one air fan 60 is sufficient to solve the problem that a recording material is curled when it is on the carrying belt in the middle of a process to form an image on the second surface.

However, when a rigid material such as thick paper is used as a recording material 70, one air fan 60 is not sufficient to suppress the curling. If the wind pressure applied to the recording material 70 via the air fan 60 is increased, it is possible to suppress the curling. However, this may cause an unfixed toner image on the second surface to be deformed.

For example, if air fans 60 and 61 having a size of 60 mm×60 mm are disposed above the carrying belt at a height of 70 mm in such a manner that they are arranged in the direction perpendicular to the paper carrying direction thereby providing a downward air stream during a copying operation, then each air stream generated by each fan will strike an area of about 60 mm×60 mm at a height 70 mm below each air fan 60 or 61, and the area will have a wind pressure of 2.5 mmHg.

The above structure and related parameters are determined such that a wind pressure is high enough to suppress great curling of a recording material 70 and low enough to produce no deformation in an unfixed toner image (refer to FIG. 3).

The two air fans 60 and 61 are located relative to each other such that the center-to-center distance L1 is 212 mm, and the space L2 between them is 152 mm. The space between the air fans is set to a value less than the length L3 of smaller sides of a B5-size paper (refer to as a B5R-size paper when placed in this way), which is the smallest-size paper of various paper sizes available for the apparatus.

If L2>L3, that is, if either air fan 60 or 61 has no area that locates above the path through which a B5R-size paper travels, then curling of a recording material 70 is not suppressed. Indeed, the behavior of the curled recording material 70 is sometimes disturbed further by the wind in the lateral direction.

On the other hand, if the space L2 between the air fans is too small, problems described below will occur.

When a recording material having a small width such as B5R is used, a concentrated air flow may scatter the developing powder, even though the curling is suppressed to a sufficient degree. If a recording material having a large width such as A3 or A4 is used, the curling cannot be suppress at peripheral portions of the recording material, while the curling can be suppressed at the central portion of the recording material. According to experiments performed by inventors of the present invention, it is preferable that the length L2 be greater than ⅓ of the width of the greatest size A3 (A4) or 297 mm. That is, it is preferable that L2 be greater than 100 mm.

The motors 60*a* and 61*a* for driving the air fans 60 and 61 are controlled by the motor controlling circuit 60*b*. The motor controlling circuit 60*b* operates in response to a signal provided by the image forming controller 60*c* for controlling the image forming apparatus itself.

In the present embodiment, as described above, two air fans 60 and 61 are disposed above the carrying belt 50. The carrying belt 50 extends from the recording material holder 5*a* to the fixing unit 9, and the fans are disposed such that a part of each air fan 60, 61 is located above the path area of a recording material of the smallest suitable size in the direction perpendicular to the recording-material carrying direction. An air flow is provided in the direction that allows the recording material 70 to be pressed against the carrying belt 50, thus preventing the carrying force from becoming insufficient due to the upward separation of the recording material 70 from the carrying belt 50, and also preventing the deformation or distortion of the image due to a failure to enter the fixing nip of the fixing unit 9 or due to contact with some element present above the carrying belt 50.

While the present embodiment uses two air fans, it should be understood that there or more fans may be used. In particular, since a plurality of air fans (in this case two air fans 60 and 61) may be used, it becomes possible to press a recording material 70 against the carrying belt 50 without increasing the wind force of each air fan to a great extent. Thus, it is possible to achieve excellent carrying performance for various recording materials such as a rigid material or a material that would be curled to a great extent if only one air fan were used, all without damaging unfixed image.

Fifth Embodiment

In the fourth embodiment described above, even when both surfaces of a recording material are subjected to a copying process, the air fans 60 and 61 are always operated during a copying operation regardless of the first or second surface of the recording material. In contrast, in this fifth embodiment, the air fans 60 and 61 are activated only during an operation of forming an image on the second surface. This can be achieved basically in the same manner as in the second embodiment.

Sixth Embodiment

In a sixth embodiment according to the present invention, the air fans 60 and 61 are operated even more efficiently compared to the above fifth embodiment.

That is, in this embodiment, the air fans 60 and 61 are operated only when a recording material 70 is present on the carrying belt 50. This is accomplished by activating the air fans 60 and 61 in synchronization with the operation of the separating blade 8*a*, basically in the same manner as in the third embodiment.

Seventh Embodiment

Figure 5:
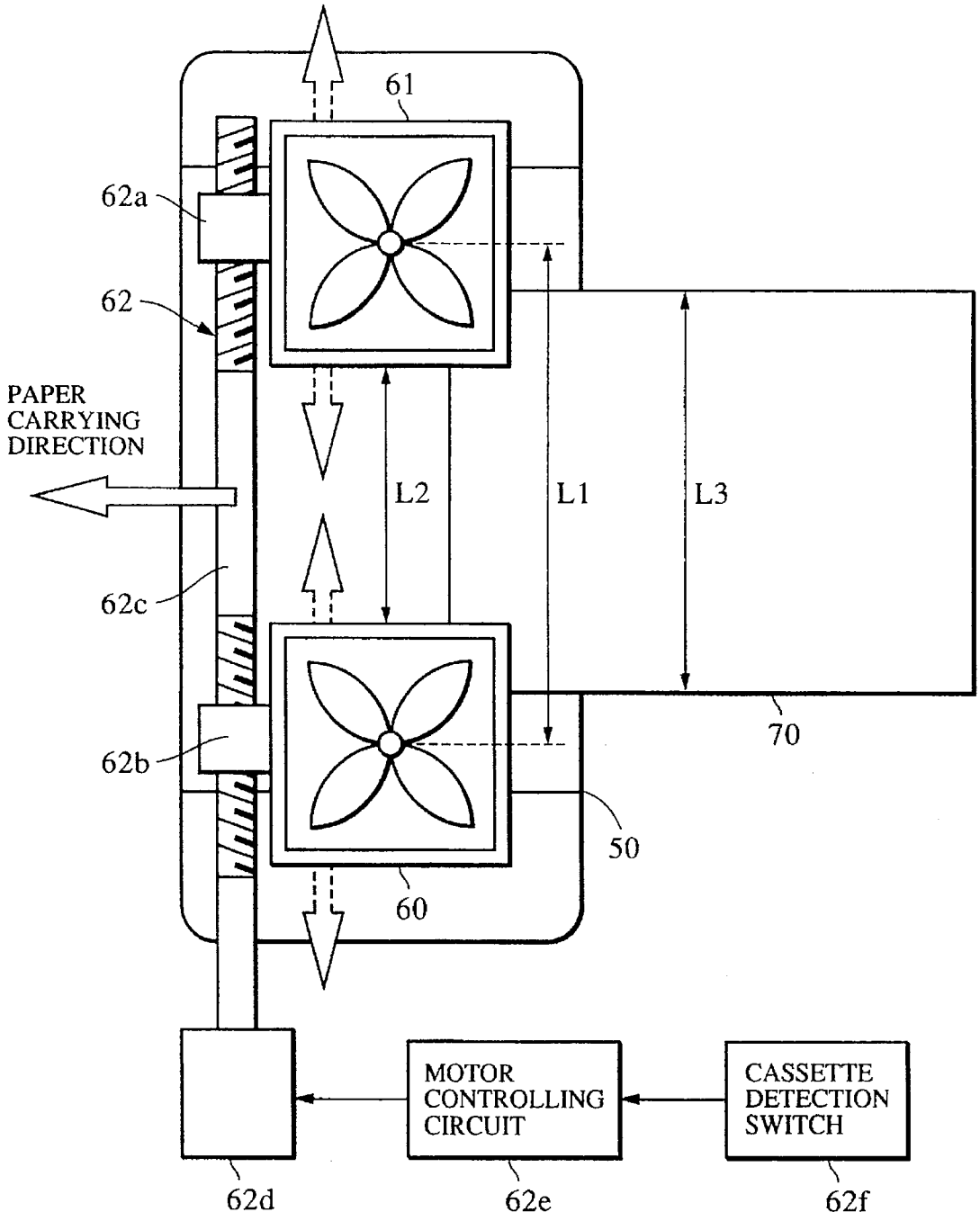
FIG. 5 is a schematic diagram illustrating a carrying portion, seen from the above, of an image forming apparatus according to a seventh embodiment of the present invention.
Figure 6:
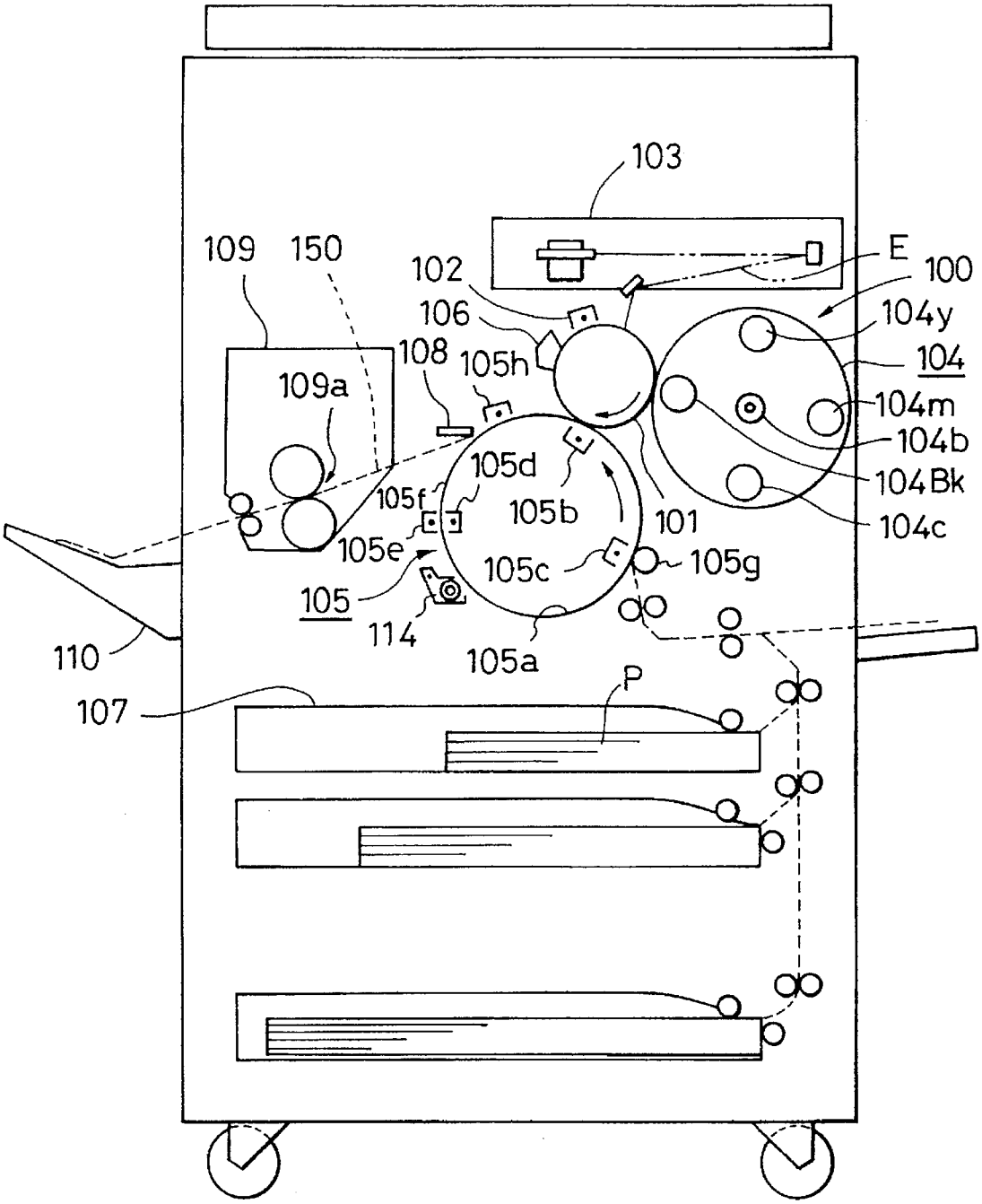
FIG. 6 PRIOR ART
FIG. 6 is a schematic diagram generally illustrating a construction of a conventional image forming apparatus.

FIG. 5 illustrates a seventh embodiment of the present invention.

In this seventh embodiment, the space L2 between the air fans 60 and 61 can be varied depending on the size of a recording material used.

For the above purpose, there is provided a moving mechanism 62 for moving the air fans 60 and 61 in the direction perpendicular to the paper carrying direction. As shown in FIG. 5, the air fans 60 and 61 are moved by a screw moving mechanism comprising: nuts 62*a* and 62*b* fixed to the respective air fans 60, 61 wherein the nuts 62*a* and 62*b* are threaded in opposite directions to each other; a screw shaft 62*c* both end portions of which are threaded in opposite directions to each other so that they may mesh with the nuts 62*a* and 62*b*, respectively; a motor 62*d* for driving the screw shaft 62*c*; and a motor control circuit 62*e* which may serve as control means and is for controlling the motor 62*d*. The air fans 60 and 61 are driven by the rotation of the motor 62*d* via the nuts 62*a* and 62*b* such that the air fans 60 and 61 are moved in opposite directions, thereby adjusting the space between the air fans 60 and 61.

The moving mechanism 62 itself can also be realized by any other means as long as it can move the air fans 60 and 61. Thus, in addition to the technique shown in FIG. 5, various types of mechanisms such as a belt driving mechanism, rack and pinion mechanism, link moving mechanism, etc., may also be employed. Alternatively, the air fans may also be adapted to be moved manually for adjusting their positions.

In this embodiment, the air blowing means is positioned corresponding to each of sizes B5R, A4R, B5, and A4 (A3) so that the distance L2 between the air fans 60 and 61 becomes optimum for any given recording material size.

The above adjustment of the distance between the air fans can be accomplished according to a signal produced by a cassette size detection switch 62*f* provided in the image forming apparatus for detecting which cassette is used.

For example, the air fans 60 and 61 are positioned such that the distance L2 between the air fans becomes 152 mm, 180 mm, 227 mm, and 267 mm for sizes B5R, A4R, B5, and A4 (A3), respectively.

The adjustability of the distance L2 between the air fans 60 and 61 according to this embodiment allows the image forming apparatus to deal with a wider variety of recording material sizes.

In the above descriptions, the embodiments of the invention are applied to an apparatus having image forming means for forming a latent image on an image holding element 1 according to electrophotography or electrostatic recording technology. However, the invention may also be applied to other apparatus such as a printer that forms an image by depositing ink droplets directly onto a recording material using, for example, an ink jet. Ink jet printers also have a problem that a recording material is curled due to the difference in expansion between a surface with deposited ink and the other surface with no ink. If the air fans according to the present embodiment are applied to such a printer, then it is possible to avoid deformation of an image occurring at an image forming portion and it is also possible to prevent a curled portion of a recording material from coming in contact with some element present above a recording material carrying means and thus preventing deformation of an image.

In the specific embodiments described above, the air fans 60 and 61 are moved in a horizontal direction parallel to the surface of carrying belt 50. However, the present invention is not limited only to that. The wind pressure may also be adjusted by moving one or more air fans toward the carrying belt 50 or in the opposite direction.

In the above specific embodiments, the invention is applied to carrying means disposed between image forming means and fixing means. The present invention may also be applied to various types of carrying apparatus. For example, the present invention may be applied to carrying means having a carrying belt or carrying roller in contact with only one face of a sheet to be carried, wherein a wind pressure is applied via air blowing means to the other face of the sheet that is not in contact with the carrying means, thereby pressing the sheet against the carrying means.

Furthermore, in the above specific embodiments, the position of the air blowing means is varied to adjust the wind pressure depending on the size, rigidness, and thickness of a sheet. However, the present invention is not limited to that. For example, the output of the air blowing means may be adjusted by varying the voltage applied to the air blowing means. Alternatively, a plurality of air blowing means may be adapted such that the most appropriate of the air blowing means is selected from them depending on the size, rigidness, or thickness of a sheet so as to provide an optimum air flow. Otherwise, the number of air blowing means may be varied depending on the size, rigidness, or thickness of a sheet.

In the present invention, as described above, air blowing means such as an air fan is disposed above carrying means extending to a fixing unit so that an air flow presses a recording material against the carrying means thereby maintaining sufficient carrying force without separation of the recording material from the carrying means. Thus, excellent and stable performance can be obtained in carrying a recording material.

With the present invention, even if a recording material is curled, the wind pressure produced by the air blowing means presses a curled portion against the surface of the carrying means, thereby keeping the recording material in good contact with the surface of the carrying means without having it separate from the carrying means. Thus, it is possible to prevent deformation of an image due to a failure to enter the fixing unit. Furthermore, it is also possible to prevent deformation of an image due to contact with some element present above the carrying means.

In particular, if there are a plurality of air blowing means, then it is possible to press a recording material against the carrying means without applying a high wind pressure that may scatter the developing powder of an unfixed image. Therefore, it is possible to obtain stable and good performance in carrying various types of recording materials such as a rigid material or a material curled to a great extent, even when that would not be dealt with well by one air blowing means.

Furthermore, if two air blowing means are disposed in such a manner that a part of each air blowing means is located above the narrowest path area of a recording material having the smallest dimension in the direction perpendicular to the travelling direction of the recording material of various kinds of recording materials to be used, then it is possible to prevent a recording material having a small width from being blown by a wind applied to the recording material in a lateral direction, and it is also possible to prevent the wind pressure from becoming too large for a recording material having a small size. On the other hand, when a recording material having a greater size is used, a greater area of the recording material can receive the wind and thus the recording material is pressed properly.

If the air blowing means is constructed using means for generating an air flow, then it is possible to easily adjust the wind pressure by controlling the rotation speed.

This can be simply realized by using an air fan.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. An image forming apparatus comprising:

image forming means for forming an image on a recording material;

fixing means for fixing the image formed on the recording material;

recording-material carrying means for carrying a recording material from said image forming means to said fixing means; and air blowing means for generating a wind pressure in a direction pressing said recording material against said recording-material carrying means, wherein the recording material is being carried between said recording-material carrying means and said air blowing means.

2. An image forming apparatus according to claim 1, wherein said air blowing means includes a plurality of air flow generating devices arranged in a direction crossing a carrying direction of the recording material.

3. An image forming apparatus according to claim 2, wherein said recording-material carrying means carries recording materials along a path, wherein the recording materials have widths ranging from narrowest width to a widest width, and each of the air flow generating devices is present above at least a part of the path of a recording material having the narrowest width.

4. An image forming apparatus according to claim 3, further comprising:

control means for controlling operation of said air blowing means; and a separating device for separating the recording material from said image forming means, wherein said control means activates said air blowing means in synchronization with operation of the separating device.

5. An image forming apparatus according to claim 2, further comprising:

control means for controlling operation of said air blowing means; and a separating device for separating the recording material from said image forming means, wherein said control means activates said air blowing means in synchronization with operation of the separating device.

6. An image forming apparatus according to claim 1, further comprising control means for controlling operation of said air blowing means, wherein said image forming means forms an image on first and second surfaces of the recording material and said control means activates said air blowing means only during a process for forming an image on the second surface of the recording material.

7. An image forming apparatus according to claim 6, further comprising a separating device for separating the recording material from said image forming means, wherein said control means activates said air blowing means in synchronization with operation of the separation device.

8. An image forming apparatus according to claim 1, further comprising;

control means for controlling operation of said air blowing means; and a separating device for separating the recording material from said image forming means, wherein said control means activates said air blowing means in synchronization with operation of the separating device.

9. An image forming apparatus according to claim 1, wherein said air blowing means generates an air flow by rotation.

10. An image forming apparatus according to claim 9, wherein said air blowing means is an air fan.

11. A sheet carrying apparatus comprising:

carrying means for carrying the sheet, one surface of the sheet being in contact with said carrying means while the sheet is being carried; and air blowing means for generating an air flow that strikes the non-contacting surface of the sheet and presses the sheet against said carrying means.

12. A sheet carrying apparatus according to claim 11, further comprising supporting means for moveably supporting said air blowing means, wherein said supporting means moveably supports said air blowing means for motion in a direction crossing the sheet carrying direction.

13. A sheet carrying apparatus according to claim 12, further including moving means for moving said air blowing means.

14. A sheet carrying apparatus according to claim 11, further comprising supporting means for moveably supporting said air blowing means, wherein said supporting means moveably supports said air blowing means for motion in a direction changing a distance between said air blowing means and said carrying means.

15. A sheet carrying apparatus according to claim 13, further including moving means for moving said air blowing means.

16. A sheet carrying apparatus according to claim 11, wherein said carrying means includes a rotating element that rotates while maintaining contact with a sheet.

17. A sheet carrying apparatus according to claim 16, wherein said rotating element includes a carrying belt.

18. A carrying apparatus according to claim 11, further including wind pressure adjustment means for varying the wind pressured applied to a sheet by said air blowing means.

19. A sheet carrying apparatus comprising:

carrying means for carrying the sheet, one surface of the sheet being in contact with said carrying means while the sheet is being carried;

air blowing means for generating an air flow that strikes the non-contacting surface of the sheet and presses the sheet against said carrying means;

supporting means for movably supporting said air blowing means; and moving means for moving said air blowing means, wherein said air blowing means includes a plurality of flow generating devices, and said moving means moves said plurality of air flow generating devices while maintaining symmetry in position of said plurality of air flow generating devices about a center line along the sheet carrying direction.

20. A sheet carrying apparatus according to claim 19, wherein said moving means moves the plurality of air flow generating devices to the positions in correspondence to the size of the sheet.

21. A sheet carrying apparatus according to claim 20, wherein the sheet has a width, the plurality of air flow generating devices is a pair, and said moving means varies the distance between said pair in accordance with the width of the sheet.

22. A sheet carrying apparatus according to claim 21, wherein said carrying means carries sheets of at least either a first width and a second width, and said moving means adjusts the distance between said pair of air flow generating devices to a first distance when the sheet has the first width, and to a second distance when the sheet has the second width, the first distance being different from the first length and the second distance being different from the second length.

23. A sheet carrying apparatus according to claim 21, wherein said moving means varies the distance between the pair of air flow generating devices such that the greater the width of the sheet the greater the distance.

24. A sheet carrying apparatus according to claim 21, further comprising detection means for detecting the width of a sheet, wherein said moving means moves the pair of air flow generating devices according to the width detected by said detecting means.

25. An image forming apparatus comprising:

image forming means for forming an image on a recording material;

fixing means for fixing the image formed on a said recording material;

recording-material carrying means for carrying a recording material between said image forming means and said fixing means, one surface of the recording material being in contact with said recording material carrying means while the recording material is being carried; and air blowing means for generating an air flow that strikes the non-contacting surface of the recording material and thereby presses the recording material against said recording-material carrying means.

26. An image forming apparatus comprising:

image forming means for forming an image on a sheet;

fixing means for fixing the image formed on the sheet;

first carrying means for carrying a sheet from said image forming means to said fixing means;

air blowing means for generating a wind pressure in a direction pressing said sheet against said first carrying means, wherein the sheet is being carried between said first carrying means and said air blowing means; and second carrying means for carrying said sheet on which the image is fixed by said fixing means, to said image forming means to form another image on said sheet.

27. An image forming means according to claim 26, wherein one surface of the sheet is in contact with said first carrying means while the sheet is being carried.

28. An image forming means according to claim 27, wherein an air flow generated by said air blowing means strikes the non-contact surface of the sheet and presses the sheet against said carrying means.

29. An image forming means according to claim 26, further comprising control means for controlling operation of said blowing means so that said air blowing means activates only during a process for carrying the sheet by said first carrying means after said image forming means forms plural images on the sheet, said image forming means comprising;

a photosensitive drum;

latent image forming means for forming an electrostatic latent image on said photosensitive drum;

developing means for developing the electrostatic latent image on said photosensitive drum into a visible image using a plurality of toner colors; and transfer means for transferring the toner image on said photosensitive drum onto a sheet.

30. An image forming apparatus comprising:

image forming means for forming an image on a sheet;

fixing means for fixing the image formed on the sheet;

first carrying means for carrying a sheet from said image forming means to said fixing means;

air blowing means for generating a wind pressure in a direction pressing said sheet against said first carrying means, wherein the sheet is being carried between said first carrying means and said air blowing means; and second carrying means for carrying said sheet on which the image is fixed by said fixing means, to said image forming means to form another image on said sheet.

31. An image forming apparatus according to claim 30, wherein one surface of the sheet is in contact with said first carrying means while the sheet is being carried.

32. An image forming apparatus according to claim 31, wherein an air flow generated by said air blowing means strikes the non-contact surface of the sheet and presses the sheet against said carrying means.

33. An image forming apparatus according to claim 30, further comprising control means for controlling operation of said blowing means so that said air blowing means activates only during a process for carrying the sheet by said first carrying means after said image forming means forms plural images on the sheet.

* * * * *

UNITED STATES PATENT AND TRADEMARK OFFICE

CERTIFICATE OF CORRECTION

PATENT NO. : 5,625,444

DATED : April 29, 1997

INVENTOR(S) : Suzuki et al.

It is certified that error appears in the above-identified patent and that said Letters Patent is hereby corrected as shown below:

On the title page, item

[30] FOREIGN PATENT DOCUMENTS:

"Jan. 24, 1994 [JP].... Japan 6-022168" should read --Jan. 21, 1994 [JP].... Japan 6-022168--.

COLUMN 1:

Line 9, "Filed" should read --Field--.

COLUMN 5:

Line 2, "EMBODIMENT" should read --EMBODIMENTS--.

COLUMN 8:

Line 45, "in" should read --is in--; and
Line 50, "an" should read --a--.

COLUMN 9:

Line 32, "(refer" should read --(referred--; and
Line 47, "suppress" should read --suppressed--.

UNITED STATES PATENT AND TRADEMARK OFFICE

CERTIFICATE OF CORRECTION

PATENT NO. : 5,625,444

DATED : April 29, 1997

INVENTOR(S) : Suzuki et al.

It is certified that error appears in the above-identified patent and that said Letters Patent is hereby corrected as shown below:

COLUMN 10:

Line 8, "there" should read --three--.

COLUMN 14:

Line 10, "pressured" should read --pressure--.

Signed and Sealed this

Fourteenth Day of October, 1997

*Attest:*

*Attesting Officer*

BRUCE LEHMAN

*Commissioner of Patents and Trademarks*